US006322480B1

(12) United States Patent
Lim et al.

(10) Patent No.: US 6,322,480 B1
(45) Date of Patent: Nov. 27, 2001

(54) INDOOR BICYCLES FOR PHYSICAL EXERCISE

(75) Inventors: Jung Soo Lim, Kaepo 1-cha Woosung Apt. 1-1502, #503 Dachi-dong, Kangnam-ku; Byung Don Lee, both of Seoul (KR)

(73) Assignee: Jung Soo Lim (KR)

( * ) Notice: Subject to any disclaimer, the term of this patent is extended or adjusted under 35 U.S.C. 154(b) by 0 days.

(21) Appl. No.: 09/408,166

(22) Filed: Sep. 29, 1999

(30) Foreign Application Priority Data

May 8, 1999 (KR) ..... 99-7756

(51) Int. Cl.[7] ..... A63B 22/06

(52) U.S. Cl. ..... 482/57; 482/61; 472/95; 472/103; 472/135

(58) Field of Search ..... 482/51, 57, 58, 482/59, 60, 61, 62, 63, 64, 65; 472/95, 101, 103, 104, 105, 135, 137, 130, 102

(56) References Cited

U.S. PATENT DOCUMENTS

| | | | |
|---|---|---|---|
| 4,925,183 | 5/1990 | Kim | 272/73 |
| 4,958,832 | 9/1990 | Kim | 272/73 |
| 5,492,516 | 2/1996 | Trotter | 482/57 |
| 5,685,806 | 11/1997 | Yu | 482/63 |
| 6,126,577 * | 10/2000 | Chang | 482/57 |

* cited by examiner

*Primary Examiner*—Mickey Yu
*Assistant Examiner*—Tam Nguyen
(74) *Attorney, Agent, or Firm*—Pillsbury Winthrop, LLP

(57) ABSTRACT

An indoor bicycle includes a bicycle chassis having a frame and pedals, a base on which the bicycle chassis is longitudinally fixed, the first housing having the first support that supports one end of the base, and the second housing having the second support that supports the other end of the base. The first panel is fixed to the lower surface of the first support. The first axle extends longitudinally from the first housing, and the first aperture is formed in the first panel and pivotally receives the first axle. The first axle, after passing through the first aperture formed in the first panel, is received in a counter aperture provided in a supporting member. The second panel is fixed to the lower surface of the second support. The second axle extends longitudinally from the second housing, and the second aperture is formed in the second panel for pivotally receiving the second axle. The second axle, after passing through the second aperture formed in the second panel, is received in a counter aperture provided in a supporting member. Therefore, rider's pedaling activities are transmitted to the base and chassis, so that the rider can feel the same swinging effects as provided by an outdoor bicycle, and the rider's muscles are not fatigued. At least one buffering member, such as coil spring, is preferably located between the second support and the second housing.

18 Claims, 5 Drawing Sheets

INDOOR BICYCLES FOR PHYSICAL EXERCISE

BACKGROUND OF THE INVENTION

The present invention relates to indoor bicycles for physical exercise, and more particularly to indoor bicycles whose base swings when a person treads the bicycle pedals.

Nowadays many people prefer indoor exercise because of convenience and easiness, and an indoor bicycle has become one of the most popular tools of doing indoor exercise without spending much time. An indoor bicycle includes a base on which the bicycle chassis is mounted. The base is fixed to the chassis so that the base may not move or swing during pedaling actions.

Therefore, when a person treads the bicycle pedals, one cannot feel the swinging activities provided by outdoor bicycles and people get easily tired of riding this kind of indoor bicycle. Moreover, since the rider's body should be maintained uniformly while he holds the handles and treads the pedals, he is likely to feel pain in his arms and shoulders.

SUMMARY OF THE INVENTION

Accordingly, the present invention provides an improvement of an indoor bicycle, the base of which swings when a person treads the bicycle pedals. The indoor bicycle of the present invention provides similar swinging activities as provided by outdoor bicycles, and thus it makes a rider neither tired of riding the bicycle nor feel muscle pain.

According to the present invention, the indoor bicycle comprises a bicycle chassis having a frame and pedals, a base on which the bicycle chassis is longitudinally fixed, the first housing having the first support that supports one end of the base, and the second housing having the second support that supports the other end of the base. The first panel is fixed to the lower surface of the first support. The first axle extends longitudinally from the first housing, and the first aperture is formed in the first panel and pivotally receives the first axle. The first axle, after passing through the first aperture formed in the first panel, is received in a counter aperture provided in a supporting member. The second panel is fixed to the lower surface of the second support. The second axle extends longitudinally from the second housing, and the second aperture is formed in the second panel for pivotally receiving the second axle. The second axle, after passing through the second aperture formed in the second panel, is received in a counter aperture provided in a supporting member. Therefore, rider's pedaling activities are transmitted to the base and chassis, so that the base can swing when a person treads the bicycle pedals. Therefore, the rider can feel the same swinging effects as provided by an outdoor bicycle, and the rider's muscles are not fatigued. Preferably at least one buffering member, such as coil spring, is located between the second support and the second housing.

One end of the first axle is non-pivotally fixed to the first housing, the intermediate portion of the first axle is pivotally inserted into the first aperture with minimum spacing therebetween, and the other end of the first axle is non-pivotally fixed to the counter aperture formed in the first supporting member. Likewise, one end of the second axle is non-pivotally fixed to the second housing, the intermediate portion of the second axle is pivotally inserted into the second aperture with minimum spacing therebetween, and the other end of the second axle is non-pivotally fixed to the counter aperture formed in the second supporting member. Consequently, the pivoting activities can occur at the intermediate portions of the first and the second axles. Bearings may be located between the first axle and the first aperture and between the second axle and the second aperture.

Alternatively, one end of the first axle is pivotally inserted into the said first housing, the intermediate portion of the first axle is non-pivotally fixed to the first aperture, and the other end of the first axle is pivotally inserted into the counter aperture formed in the first supporting member. One end of the second axle is pivotally inserted into the second housing, the intermediate portion of the second axle is non-pivotally fixed to the second aperture, and the other end of the second axle is pivotally inserted into the counter aperture formed in the second supporting member. Under these circumstances, the first and the second supporting members are fixed to the first and the second axles respectively, and the first and the second axles can provide pivoting activities. Bearings may be located between the first axle and the first housing, between the first axle and the counter aperture formed in the first supporting member, between the second axle and the second housing, and between the second axle and the counter aperture formed in the second supporting member.

BRIEF DESCRIPTION OF THE DRAWINGS

These and other features and advantages of the invention as well as various modifications and alterations will be more completely understood from the following description of a preferred embodiment given by way of non-limiting example, taken together with the accompanying drawings, in which.

DESCRIPTION OF THE PREFERRED EMBODIMENT

Figure 1:
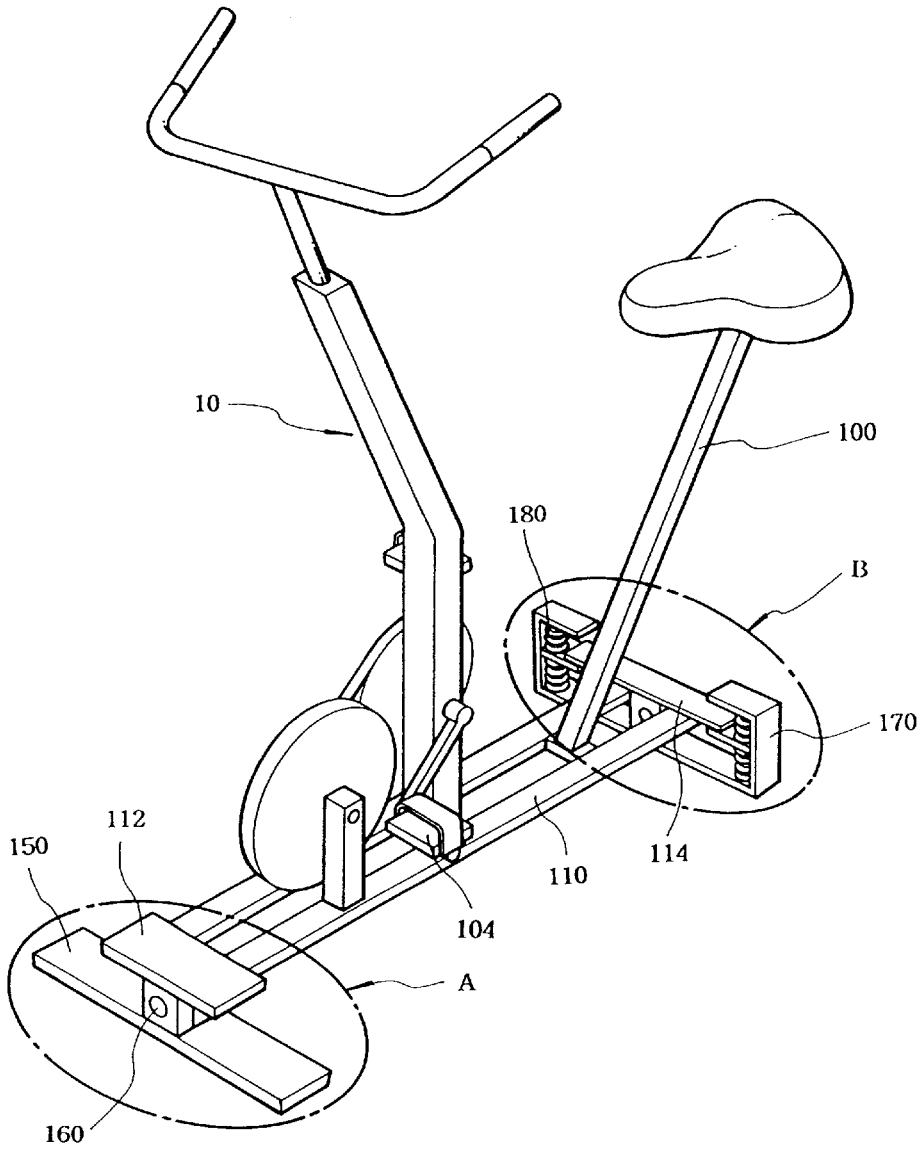
FIG. 1 is a simplified representation of the indoor bicycle according to the present invention.

The preferred embodiment of the present invention is schematically illustrated in FIG. 1. According to the present invention, the indoor bicycle comprises a bicycle chassis 10 having a frame 100 and pedals 104; a base 110 on which the bicycle chassis 10 is longitudinally fixed; the first housing 150 having the first support 112 supporting one end of the base 110; and the second housing 170 having the second support 114 supporting the other end of the base 110. The base 110 and the first support 112 or the second support 114 may be welded or screwed, or they may be integrally molded.

Figure 2:
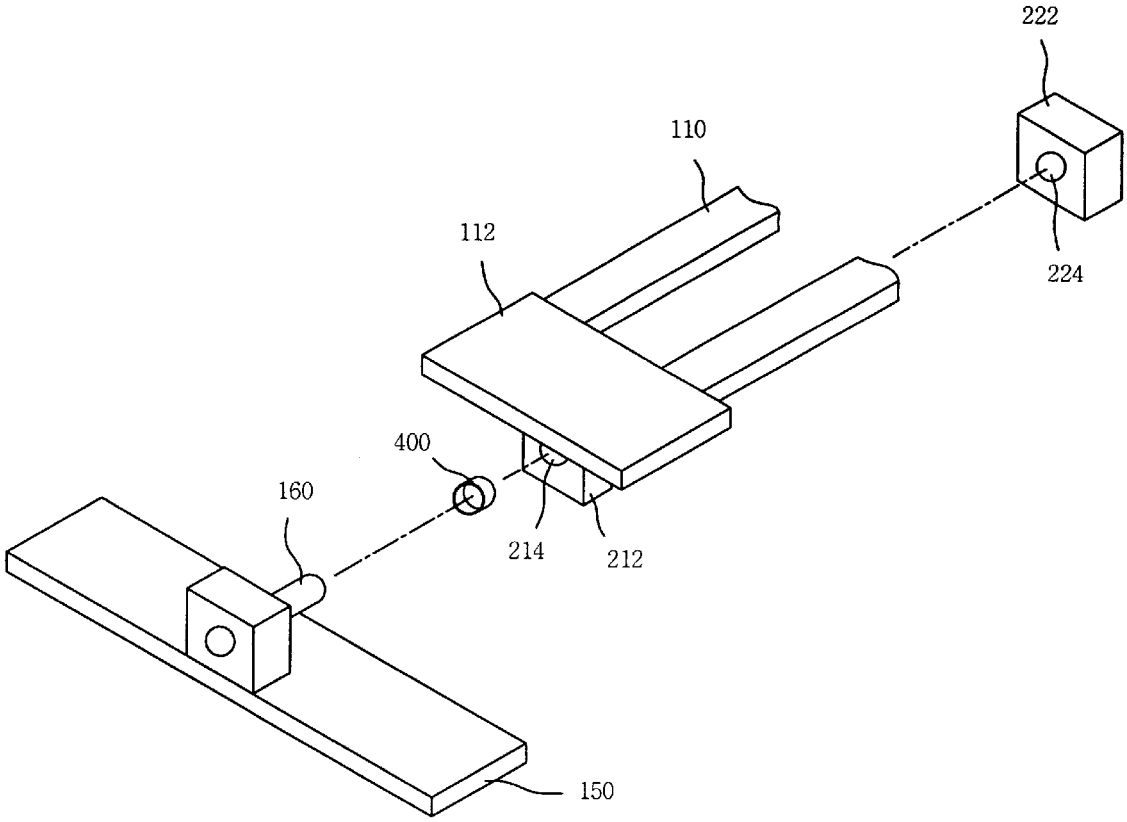
FIG. 2 is an enlarged view for the portion A in FIG. 1, wherein parts are disassembled.

Referring to FIG. 2, the first panel 212 is located under the first support 112, and an aperture 214 is formed in the first panel 212. The first support 112 and the first panel 212 may be welded or screwed, or they may be integrally molded.

The first axle 160 is extended longitudinally from the first housing 150, and inserted into the aperture 214 of the first panel 212. Preferably, the diameter of the aperture 214 and the outer diameter of the first axle 160 are determined to provide a minimum spacing therebetween for allowing the pivoting activities. Alternatively, a bearing 400 may be located between the aperture 214 and the first axle 160.

The first axle 160, after passing through the aperture 214, is further inserted, in a non-pivoting manner, into a counter aperture 224 formed in a supporting member 222. The lower surface of the supporting member 222 is fixed to the first housing 150 by welding, screwing or other means.

Under these structures, the first support 112, and thereby the base 110, may perform pivoting activities around the first axle 160 which extends between the first hosing 150 and the counter aperture 224.

Figure 4:
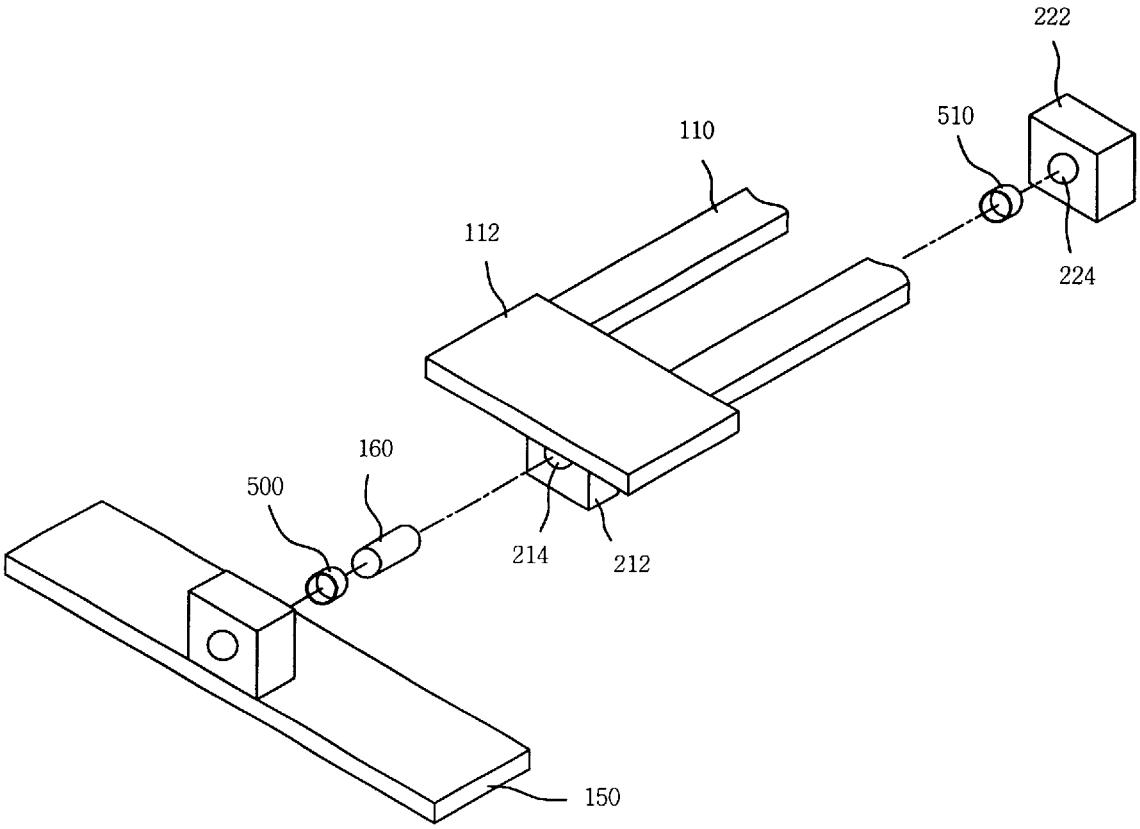
FIG. 4 is an enlarged view showing another embodiment of the portion A in FIG. 1, wherein parts are disassembled.

Alternatively, as shown in FIG. 4, the outer diameter of the first axle 160 and the diameter of the aperture 214 may be exactly the same, so that no pivoting activities can occur. In this case, both ends of the first axle 160 should be pivotally inserted to the first housing 150 and the counter aperture 224. Under these structures, the first support 112 and the base 110 may also perform pivoting activities around the first axle 160, and bearings 500, 510 may be located between the first axle 160 and the first housing 150 and between the first axle 160 and the counter aperture 224 formed in the first supporting member 222.

Figure 3:
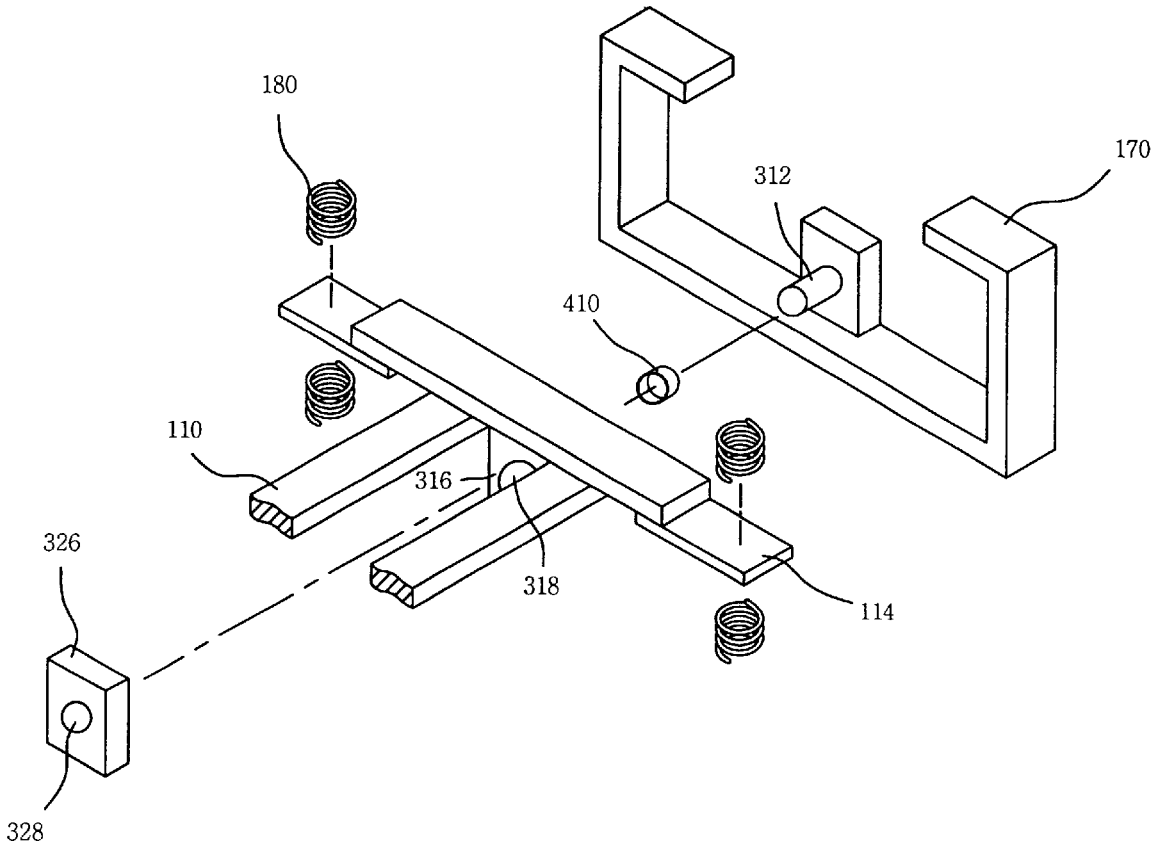
FIG. 3 is an enlarged view for the portion B in FIG. 1, wherein parts are disassembled.

Now referring to FIG. 3, the other end of the base 110 is fixed to the second support 114. The second panel 316 is located under the second support 114, and an aperture 318 is formed in the second panel 316. The second support 114 and the second panel 316 may be welded or screwed, or they may be integrally molded. The second axle 312 is extended longitudinally from the second housing 170, and inserted into the aperture 318 of the second panel 316. Preferably, the diameter of the aperture 318 and the outer diameter of the second axle 312 are determined to provide a minimum spacing therebetween for allowing the pivoting activities. Alternatively, a bearing 410 may be located between the aperture 318 and the second axle 312.

The second axle 312, after passing through the aperture 318 of the second panel 316, is further inserted, in a non-pivotal manner, into a counter aperture 328 formed in a supporting member 326. The lower surface of the supporting member 326 is fixed to the second housing 170 by welding, screwing or other means.

Under these structures, the second support 114, and thereby the base 110, may perform pivoting activities around the second axle 312 which extends between the second housing 170 and the supporting member 326.

Figure 5:
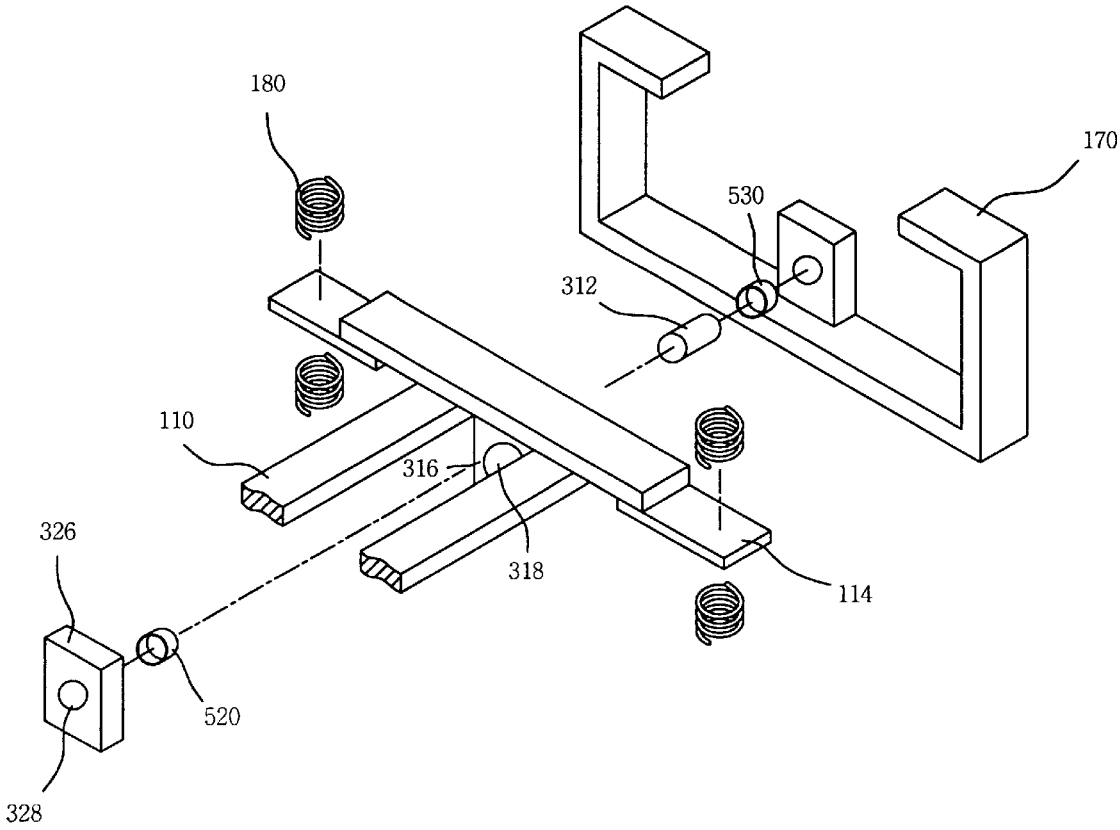
FIG. 5 is an enlarged view showing another embodiment of the portion B in FIG. 1, wherein parts are disassembled.

Alternatively, as shown in FIG. 5, the outer diameter of the second axle 312 and the diameter of the aperture 318 may be exactly the same, so that no pivoting activities can occur. In this case, both ends of the second axle 312 should be pivotally inserted to the second housing 170 and the counter aperture 328. Under these structures, the second support 114 and the base 110 may also perform pivoting activities around the second axle 312, and bearings 520, 530 may be located between the second axle 312 and the second housing 170 and between the second axle 312 and the counter aperture 328 formed in the second supporting member 326.

A buffering member 180, such as coil spring, is located between the second support 114 and the second housing 170. Although four coil springs 180 are shown in FIG. 3, the number and the kind of buffering members may be properly decided by those skilled in the art. Ends of the buffering members are fixed to the second housing 170 or the second support 114, preferably by welding. On the other hand, the first and the second housings 150, 170 may be molded separately or integrally.

When a person treads the bicycle pedals, it is natural that the rider's body should swing laterally. According to the present invention, the lateral swing is transmitted to the base 110 via chassis 100. As ends of the base 110 are fixed to the first and the second supports 112, 114, the lateral swinging force is also transmitted to the first and the second supports 112, 114, making the latter swing around the first and the second axles 160, 312. When the first and the second supports swing, the base 110 which is fixed to these supports 112, 114, and the chassis 10 which is fixed to the base 110, will also swing.

By selecting appropriate spring constants of the buffering members 180, the swinging activities of the indoor bicycle may be limited within the acceptable scope, and smooth transitions from the left to the right or from the right to the left is possible.

Those skilled in the art will recognize that the invention has been described with respect to a specific detailed embodiment and that this description is merely illustrative of the invention. Obviously, different types of indoor bicycles with swinging activities could be modified and produced according to the principles of the present invention. The specific embodiment is therefore illustrative of the invention that is defined in the appended claims.

What is claimed is:

1. An indoor bicycle having lateral swinging activities, comprising:

a bicycle chassis having a frame and pedals;

a base on which said bicycle chassis is longitudinally fixed;

a first housing having a first support that supports one end of said base;

a first panel fixed to a lower surface of said first support;

a first axle extending longitudinally from said first housing;

a first aperture formed in said first panel and pivotally receiving said first axle;

a first supporting member having a counter aperture for receiving said first axle that has passed through said first aperture;

a second housing having a second support that supports another end of said base;

a second panel fixed to a lower surface of said second support;

a second axle extending longitudinally from said second housing;

a second aperture formed in said second panel for pivotally receiving said second axle; and a second supporting member having a counter aperture for receiving said second axle that has passed through said second aperture.

2. An indoor bicycle according to claim 1, wherein at least one buffering member is located between said second support and said second housing.

3. An indoor bicycle according to claim 2, wherein said buffering member is a coil spring.

4. An indoor bicycle according to claim 1, wherein:

one end of said first axle is non-pivotally fixed to said first housing;

an intermediate portion of said first axle is pivotally inserted into said first aperture with minimum spacing therebetween;

another end of said first axle is non-pivotally fixed to said counter aperture formed in said first supporting member;

one end of said second axle is non-pivotally fixed to said second housing;

an intermediate portion of said second axle is pivotally inserted into said second aperture with minimum spacing therebetween;

another end of said second axle is non-pivotally fixed to said counter aperture formed in said second supporting member; and pivoting occurs at the intermediate portions of said first and second axles.

5. An indoor bicycle according to claim 2, wherein:

one end of said first axle is non-pivotally fixed to said first housing;

an intermediate portion of said first axle is pivotally inserted into said first aperture with minimum spacing therebetween;

another end of said first axle is non-pivotally fixed to said counter aperture formed in said first supporting member;

one end of said second axle is non-pivotally fixed to said second housing;

an intermediate portion of said second axle is pivotally inserted into said second aperture with minimum spacing therebetween;

another end of said second axle is non-pivotally fixed to said counter aperture formed in said second supporting member; and pivoting occurs at the intermediate portions of said first and second axles.

6. An indoor bicycle according to claim 3, wherein:

one end of said first axle is non-pivotally fixed to said first housing;

an intermediate portion of said first axle is pivotally inserted into said first aperture with minimum spacing therebetween;

another end of said first axle is non-pivotally fixed to said counter aperture formed in said first supporting member;

one end of said second axle is non-pivotally fixed to said second housing;

an intermediate portion of said second axle is pivotally inserted into said second aperture with minimum spacing therebetween;

another end of said second axle is non-pivotally fixed to said counter aperture formed in said second supporting member; and thereby pivoting occurs at the intermediate portions of said first and second axles.

7. An indoor bicycle according to claim 4, wherein bearings are located between said first axle and said first aperture and between said second axle and said second aperture.

8. An indoor bicycles according to claim 5, wherein bearings are located between said first axle and said first aperture and between said second axle and said second aperture.

9. An indoor bicycle according to claim 6, wherein bearings are located between said first axle and said first aperture and between said second axle and said second aperture.

10. An indoor bicycle according to claim 1, wherein:

one end of said first axle is pivotally inserted into said first housing;

an intermediate portion of said first axle is non-pivotally fixed to said first aperture;

another end of said first axle is pivotally inserted into said counter aperture formed in said first supporting member;

one end of said second axle is pivotally inserted into said second housing;

an intermediate portion of said second axle is non-pivotally fixed to said second aperture;

another end of said second axle is pivotally inserted into said counter aperture formed in said second supporting member; and said first and second supporting members are fixed to said first and second axles respectively, and said first and second axles can provide pivoting activities.

11. An indoor bicycle according to claim 2, wherein:

one end of said first axle is pivotally inserted into said first housing;

an intermediate portion of said first axle is non-pivotally fixed to said first aperture;

another end of said first axle is pivotally inserted into said counter aperture formed in said first supporting member;

one end of said second axle is pivotally inserted into said second housing;

an intermediate portion of said second axle is non-pivotally fixed to said second aperture;

another end of said second axle is pivotally inserted into said counter aperture formed in said second supporting member; and said first and second supporting members are fixed to said first and second axles respectively, and said first and second axles can provide pivoting activities.

12. An indoor bicycle according to claim 3, wherein:

one end of said first axle is pivotally inserted into said first housing;

an intermediate portion of said first axle is non-pivotally fixed to said first aperture;

another end of said first axle is pivotally inserted into said counter aperture formed in said first supporting member;

one end of said second axle is pivotally inserted into said second housing;

an intermediate portion of said second axle is non-pivotally fixed to said second aperture;

another end of said second axle is pivotally inserted into said counter aperture formed in said second supporting member; and said first and second supporting members are fixed to said first and second axles respectively, and said first and second axles can provide pivoting activities.

13. An indoor bicycle according to claim 10, wherein bearings are located between said first axle and said first housing, between said first axle and said counter aperture formed in said first supporting member, between said second axle and said second housing, and between said second axle and said counter aperture formed in said second supporting member.

14. An indoor bicycle according to claim 11, wherein bearings are located between said first axle and said first housing, between said first axle and said counter aperture formed in said first supporting member, between said second axle and said second housing, and between said second axle and said counter aperture formed in said second supporting member.

15. An indoor bicycle according to claim 12, wherein bearings are located between said first axle and said first housing, between said first axle and said counter aperture formed in said first supporting member, between said second axle and said second housing, and between said second axle and said counter aperture formed in said second supporting member.

16. An indoor bicycle according to claim 1, wherein said first housing and said second housing are made as an integral part.

17. An indoor bicycle according to claim 2, wherein said first housing and said second housing are made as an integral part.

18. An indoor bicycle according to claim 3, wherein said first housing and said second housing are made as an integral part.

* * * * *